US005888947A

United States Patent [19]

Lambert et al.

[11] Patent Number: 5,888,947

[45] Date of Patent: Mar. 30, 1999

[54] VEGETABLE OIL LUBRICANTS FOR INTERNAL COMBUSTION ENGINES AND TOTAL LOSS LUBRICATION

[75] Inventors: James W. Lambert, Colorado Springs; Duane L. Johnson, Ft. Collins, both of Colo.

[73] Assignee: Agro Management Group, Inc., Colorado Springs, Colo.

[21] Appl. No.: 912,130

[22] Filed: Aug. 15, 1997

Related U.S. Application Data

[63] Continuation-in-part of Ser. No. 468,417, Jun. 6, 1995, abandoned.

[51] Int. Cl.[6] ..... C10M 105/38; C10M 129/76; C10M 139/70

[52] U.S. Cl. ..... 508/491; 508/501

[58] Field of Search ..... 508/491, 501

[56] References Cited

U.S. PATENT DOCUMENTS

| | | | |
|---|---|---|---|
| 3,740,333 | 6/1973 | Hutchinson et al. | 252/48.6 |
| 4,152,278 | 5/1979 | Bell | 252/56 |
| 4,380,498 | 4/1983 | Kammann, Jr. et al. | 252/48.6 |
| 4,380,499 | 4/1983 | Kammann, Jr. et al. | 252/48.6 |
| 4,557,842 | 12/1985 | Arndt | 252/32.7 |
| 4,737,297 | 4/1988 | Yoshida et al. | 252/9 |
| 4,740,324 | 4/1988 | Schur | 252/56 |
| 4,749,517 | 6/1988 | Chwang et al. | 252/56 |
| 4,783,274 | 11/1988 | Jokinen | 252/47 |
| 4,873,008 | 10/1989 | Landis et al. | 252/46.6 |
| 4,925,581 | 5/1990 | Erickson et al. | 252/48 |
| 4,960,528 | 10/1990 | Everett et al. | 252/32 |
| 4,970,010 | 11/1990 | Erickson et al. | 252/48.6 |
| 5,141,657 | 8/1992 | Feterman, Jr. et al. | 252/32 |
| 5,320,761 | 6/1994 | Hoult et al. | 252/9 |
| 5,413,725 | 5/1995 | Lal et al. | 252/18 |
| 5,427,704 | 6/1995 | Lawate | 508/491 |
| 5,451,334 | 9/1995 | Bongardt et al. | 252/56 R |
| 5,468,405 | 11/1995 | Klein et al. | 252/56 R |

OTHER PUBLICATIONS

Gunther, Raymond C., Lubrication, 1971, pp. 85–113.

*Primary Examiner*—Jerry D. Johnson
*Attorney, Agent, or Firm*—Patent Law Offices of Rick Martin, P.C.

[57] ABSTRACT

The vegetable oil based lubricant of the present invention is derived primarily from plants, a renewable resource. It is readily biodegradable via α- and β-oxidation utilizing microbes naturally present in the environment and is non-toxic to flora and fauna. The vegetable based lubricant of the invention includes a mono-, di- and trigycerol base oil making up the majority of the composition, a vegetable oil additive containing hydroxy fatty acids and a liquid vegetable wax. Additional antioxidants derived from natural vegetable or petroleum sources may be used. The base oil is primarily derived from the families Cruciferae, Leguminosae or Compositae. The vegetable oil additive is principally derived from castor or lesquerella and the vegetable wax from jojoba or meadowfoam. The invention is suitable for use in internal combustion engines and in total loss applications. The invention is designed as a total composition for its applications and is not an additive to petroleum lubricants.

131 Claims, No Drawings

VEGETABLE OIL LUBRICANTS FOR INTERNAL COMBUSTION ENGINES AND TOTAL LOSS LUBRICATION

CROSS REFERENCE PATENTS

This application is a continuation in part of application Ser. No. 08/468,417, filed on Jun. 6, 1995 now abandoned.

BACKGROUND OF THE INVENTION (1)Field of the Invention

The present invention relates to the use of vegetable oils in environmentally sound applications as a total replacement for current petroleum and vegetable-based additives to petroleum. Its use in applications to internal combustion engines provides not only acceptable biodegradability but superior lubricity to petroleum lubricants. In total loss applications, such as rail oils and chain oils, it provides superior lubricity, heat transfer and rapid degradation after disposal desired by users.

(2)Description of the Related Art

The principal use of motor oils is to prevent metal-to-metal contact between moving engine parts with respect to heat and friction. In the absence of a lubricant, friction caused by the rubbing of the moving parts creates heat. Heat then acts to weld tiny imperfections in the moving parts together. The welds then tear and re-weld themselves. This process, referred to as "scuffing", if allowed to continue, will cause engine failure.

Motor oils prevent the metal-to-metal contact by forming a film between moving parts. In addition to reducing friction between moving parts, the lubricant also functions as a coolant for the parts, a corrosion preventative and as a sealant for engine rings.

Total loss applications are quite similar to motor oils. The difference being that total loss oils are used once, briefly, and then are discarded in the proximate environment. Examples of total loss applications include rail oils for trains, bar/chain oils for wood cutting and metal cutting oils. The immediate consumption of total loss oils is relatively insignificant but the cumulative effect is dramatic. A train alone may consume 5 gallons of oil per 1,000 miles as the oil is sprayed on the track to lubricate the wheels. This amounts to a total of 300,000 gallons annually being discarded along railings within the U.S. alone.

Traditionally, mineral oils, produced from petroleum, have been the primary source of engine lubricants, as well as total loss application. The petroleum oils are composed primarily of hydrocarbons in nature and therefore lack chemical functionality. These petroleum oils are structurally composed of naphthenic, parafinic or aromatic structures.

Naphthenic structures have common, general characteristics: they have low viscosity, good pour points and poor oxidative stability. Paraffinic structures also have common characteristics: they have higher viscosity, high pour points and good oxidative stability. Aromatic structures generally have very high viscosity, variable pour points and poor oxidative stability.

Lubricants are made by distilling and refining crude petroleum. A host of various chemicals are added to this petroleum base to improve their physical properties and performances. As an example, various polymeric substances are added to the base oil to improve viscosity and act as a dispersant. Micronized polytetraflouroethylene (PTFE) is added to provide lubricity and reduce engine wear. Various amines, metal phenates and zinc salts are added as antioxidants.

In some formulations, notably the "synthetic oil" or "blended synthetic oil" formulations, additional micronized nylons or modified vegetable oils are added for additional lubricity and thermal stability. Finally, alkaline-earth phenates are added to neutralize acids and reduce wear.

Petroleum based lubricants suffer from a number of drawbacks. The crude petroleum from which they are derived is a nonrenewable resource. The world oil reserves are, if current consumption levels continue, expected to be exhausted within 40 years. Additionally, petroleum based motor oils are highly toxic to the environment and are hazardous to both the flora and fauna. Recent studies indicate these oils are carcinogenic and they are classified as a hazardous waste. Finally, petroleum based oils, with their chemical additives are not readily degraded in the environment. As a result, they persist for long periods in an ecosystem. The ecological problems associated with the refining and disposal of petroleum products are well known.

A second group of available lubricants are the synthetic oils. Synthetic oils have been developed to obtain intrinsic qualities such as lubricity and thermal stability. They are frequently designed for use in extreme conditions such as extreme temperature, vacuum, radiation or chemical environments. The most common synthetic lubricants are silicones, polyglycols, phosphate esters, dibasic acid esters and silicate esters. Synthetic lubricants are relatively costly and also suffer from a multitude of drawbacks similar to those of petroleum. They are frequently toxic to the environment, hazardous to flora and fauna and are not readily biodegradable.

A third group are the fixed oils. Fixed oils are fatty substances derived from animals, plants and fish. They are called fixed oils since they will not volitilize without decomposing. Fixed oils are generally composed of fatty acids and alcohols, the radicals of which are joined to form fatty acid esters. These transesterified oils are frequently blended with petroleum to provide functionality to the petroleum and reduce cost since transesterification is an expensive process and a pure fixed oil product would not be commercially feasible. Although the fixed oils by themselves are biodegradable, once they are mixed with petroleum this is lost.

Consequently, there is a strong need for an effective motor oil which can lubricate moving metal parts in internal combustion engines, which is derived from a renewable resource, is non-toxic to the environment and is readily biodegradable, preferably by microbes naturally present in the environment. The oil should also be cost effective to produce and market. It should also be usable in total loss applications.

Prior teachings in applications of vegetable oils for lubrication have been focused on the use of these oils as additives to a petroleum base oil. Prior teachings have emphasized that vegetable oils are functional as additives in petroleum lubricants for engines and transmissions. Their enhanced lubricity has significantly improved the efficacy of petroleum but they are rarely used at percentages exceeding 20 percent of the composition by volume of the final lubricant. Other applications primarily use a transesterified vegetable oil, converting the glycerols to a free fatty acid form prior to use.

BRIEF SUMMARY OF THE INVENTION

The present invention improves upon the prior art by providing a liquid lubricant that is composed principally of vegetable based components. Petroleum-based additives to the base oil are not excluded in the present teachings. Unlike the conventional lubricants of the prior art, the vegetable based oil of the present invention is derived from a renewable source, is biodegradable by naturally occurring microbes in the environment and is non-toxic to flora and fauna.

The present invention has three main components: a base oil, an oil source containing hydroxy fatty acids and an oil source containing vegetable or animal waxes. The base oil used in the invention needs to consist of primarily triglycerols (triglycerides) and mono- and diglycerols (glycerides) and free fatty acids. The composition further consists of vegetable oils where the glycerols contain hydroxy fatty acids, preferably making up 5% to 20% of the oil. A third major component is waxes composing 5% to 10% of the oil additives by volume. Additional synthetic mimics or natural products derived from animal or vegetable compounds may be added up to 5% of the compositional volume.

The base oil is derived from a variety of unrefined vegetable oil sources including any of the following: soybean, high oleic soybean (>60% oleic acid), canola, high oleic canola (>72% oleic acid), rapeseed high oleic rapeseed (>65% oleic acid), crambe, safflower, high oleic safflower (>75% oleic acid), sunflower, high oleic sunflower (>80% oleic acid) and, in fact, any vegetable oil where the primary fatty acid composition of the triglycerol is 16 to 24 carbons in length. Currently, the preferred base oil is canola also known as low erucic rapeseed.

The hydroxy fatty acids can be derived from castor, lesquerella or other hydroxy fatty acid sources. Hydroxy fatty acids can also be derived from the activity of lipoxigenase enzymes on any of the above vegetable oils. The preferred source of hydroxy fatty acids is castor.

The most common sources of the waxes being derived from jojoba, meadowfoam or lanolin. The preferred source of these waxes are jojoba or synthetic dimers derived from free fatty acids and fatty alcohols either coontrived or through genetically engineered plants.

Various antioxidants are natural with the crude vegetable oils used. Synthetic anti oxidants sources also acceptable. Preferred synthetic mimics include pyrazines and other cyclic antioxidants. Natural antioxidants include pyridines and lectins.

Accordingly, it is an aspect of the present invention to provide a competitively priced, vegetable based lubricant which can be manufactured from renewable resources, is non-toxic and biodegradable. A further aspect of the current invention is to provide an effective lubricant for internal combustion engines and for total loss applications.

These and other aspects of the present invention will become apparent from the detailed description and claims that follow.

DETAILED DESCRIPTION OF THE INVENTION

The vegetable based liquid lubricant composition of the invention, unlike lubricants of the prior art, is derived from a renewable source, is non-toxic to flora and fauna and is readily biodegradable by microorganisms present in the earth's environment. Initially the lubricant was developed for use in internal combustion engines, particularly for use in four cycle engines (i.e. lawnmower engines) and in small engine applications for fragile ecosystems (i.e. deserts, forests, tundras and wetlands). The invention, however, appears to have a much broader application range in all forms of internal combustion engines. Moreover, it is envisioned that the lubricant composition of the invention has applicability in general lubrication of machinery and may be adaptable to total loss applications as well as in hydraulics and greases.

The vegetable based lubricant of the invention includes a base oil composed of mono-, di- and triglycerols making up the majority of the composition where at least 75% of the fatty acids have a chain length of 16 carbons or greater. The composition also contains added mono-, di- and triglycerols which contain hydroxy fatty acids and liquid vegetable waxes. A more descriptive analysis of the oils are given in Table 1.

TABLE 1

| | Typical lubricant formulations currently under evaluation | | | |
|---|---|---|---|---|
| Component | Bar-Chain | Rail Oil/ Cutting Oil | Small Air Cooled Engine | Automotive Engine |
| Canola Oil | 85% | 90% | 82% | 75% |
| Castor Oil | 10% | 3% | 10% | 13% |
| Jojoba Oil | 5% | 2% | 5% | 7% |
| Antioxidants | 0% | 0% | 3% | 5% |

The best formulation to date for a general purpose oil consists of 85% by volume of base oil, 10% by volume oil sources containing hydroxy fatty acids and 5% by volume liquid wax sources. Specific applications may require modificaion of the base formulation as well as the addition of antioxidants.

The base oil is the largest component of the lubricant composition. The preferable percentage of the base oil will vary with its fatty acid composition and its intended use. With small, air cooled engines ranging from 3.5 to 20 hp, the percentage of the base oil will vary between 75% and 85% of the composition by volume.

A high percentage of at least 65% of 16 to 22 carbon fatty acids is required in order for the base oil to provide adequate lubrication. Longer chain fatty acid sources are preferred to provide longevity to the oil. Preferred sources of long chain fatty acids are from members of the family Cruciferae, the family Compositae and the family Leguminosae. Common oilseeds in these families are [Cruciferae] canola, rapeseed, crambe, lesquerella; [Compositeae] sunflower, safflower, flax, meadowfoam; and [Leguminoseae] soybean. Other sources of the base oil include cotton, corn, olive, peanut and other common oils. Each base oil has unique functionality and lubricant formulations will vary depending upon base oil used.

In addition the base oil can be made by combining any of the above oils. This allows additional fine tuning of the qualities of the base oil. A number of blends have been tested. A blend of Rapeseed and canola oil has been tested and worked well. The ratio of Rapeseed to canola can be varied greatly. Currently a blend of 80% canola and 20% rapeseed is being tested with good results.

Blends of crambe oil and canola oil have also been tested and work well. The conventional and high oleic types Safflower or Sunflower oils all worked well as a base oil when blended with canola oil. As with rapeseed, the ratio of the blends does not appear in be particularly important with crambe, safflower or sunflower oils.

Blends of canola oil and soybean oil have also been tested.

A blend of 17% soybean and 83% canola is currently preferred. If the amount of soybean oil is more than 20%, decreases in oxidative stability have been noted. Soybean oil is particularly convenient as a component of the invention due to the large amount of soybeans grown world wide. It is a very common crop all over the world, so the oil is generally easily available at low cost.

The components of the base oil other than the mono-, di- and triglycerols (glycerides) also play an important role in the functionality of the invention. The phosphotidyl cholines (i.e. lethicin and lectins) function in tying up metal contaminants, acting as an antioxidant as well as water absorbtion in the oil. Aliphatic alcohols, terpenoids and saponins appear to function as detergents. Waxes and hydroxy fatty acids are particularly well suited to bonding to metals, assuring the user of reduced metal-to-metal contact. Naturally occurring pyrazines, vitamins (tocopherols) and pigments function as antioxidants. Hydroxy fatty acids also aid in the dimerization process, creating addtional wax esters and branched fatty acids.

Consequently, the preferred methods for oil extraction utilize cold-pressing, liquid $CO_2$ extraction or screw-pressing. The applicant currently uses cold pressed oils in its formulations. Screw pressed oils have been tested and also work well. The liquid $CO_2$ extraction systems for oil extraction are still experimental, but theoretically should yield similar results.

Solvent extracted oils are also acceptable although some of the natural antioxidants are destroyed in processing and must be replaced. Synthetic antioxidants include alkylated phenols, polyethers, substituted triazoles and diphenolamines and may be used to replace or enhance natural antioxidants. Synthetic antioxidants may vary from 0.1% to 5% of the blended oil. The base oils are typically used in their unrefined state. Unrefined means that no degumming, bleaching or deodorizing of the oil is used.

The use of commercially prepared oils ( denuded of gums, waxes, alcohols and antioxidants) requires the addition of commercial lectins, waxes and antioxidants prior to use in the invention but can be utilized in the same way as the natural components.

Some types of base oil may require additional processing to bring the composition of the base oil into the optimal range for glyceride composition. Soybean oil is one base oil that is known to need additional processing to be suitable for use as a base oil. Interesterification and/or transesterification may be used to stablizes the base oil. One method of processing is to use alkali isomerization or clay catalyzation to form monocyclic and bicyclic fatty acids which are hydrogenated to form alicyclic and aromatic rings (the Diers-Alder Reaction). Alternatively, a Simmons-Smith reaction using methylene iodide and zinc-copper catalysts can be used to form cyclopropanes. A third method is to expose the fatty acids and triglycerides to oxygenase enzymes to produce soy hydroxy fatty acids. This would provide a fatty acid composition resembling ricinoleic (i.e. castor) fatty acids. To reduce crystallization temperatures, the method of Lee, Johnson and Hammond (1995) could be used to form branched chain fatty acid esters.

In addition to the base oil, the vegetable based biodegradable liquid lubricant composition includes vegetable oils containing hydroxy fatty acids as mono-, di- or triglycerols (containing an OH group where hydrogen is normally placed in edible oils). The hydroxyl groups are very reactive and help to prevent the breakdown of the oils under extreme (heat and friction) conditions by forming dimers as well as reacting with metals in contact with the lubricant. Preferably, the hydroxy fatty acids make up 5% to 15% of the oil composition (see Table 1).

Sources of the hydroxy oils can be from castor, lesquerella or other hydroxy fatty acid sources. Although canola, rapeseed and the other base oils do not naturally have the hydroxy fatty acids necessary to function as a hydroxy oil, they can be processed so that it is possible to use one of them as the hydroxy oil as well using various oxygenase such as lipoxygenase.

The oils need to be dimerized and esterified in order to produce the necessary hydroxy fatty acids. There are a variety of known protocols which are used to accomplish the dimerization and esterification. For example, urea can be used to fractionate triglycerides into fatty acids. Once free fatty acids are formed, additional modifications as described above can be made.

Another method is to use polyenes with 3 or more double bonds to react with alkali salts to produce trans addition products which be converted to cyclized compounds (monocyclic cyclohexadiene or bicyclic indene) systems via the Simmons-Smith reaction and the Diels-Adler reaction. Dimerization is occuring between alkene chains and is increased in the presence of hydroxy fatty acids and heat. Therefore, it is likely that dimerization is an ongoing reaction once the oil is put to use in an internal combustion engine.

A second method employs branch-chain fatty acids derived from diene or other polyene sources. The use of dimers or branch chain fatty acids to reduce pour point is showing promise.

A third method is the interesterification of triacylglycerols (triglycerides) to produce uniform monene and a very monounsaturated oil for lubricant stability. The oil is mixed with a base catalyst and heated to 40° C. Saturated triacylglycerols can be collected and removec at relatively low temperature, causing additional saturated triacylglycerols to form. Eventually, almost pure monene and diene triglycerols can be collected.

Liquid wax esters derived from oilseeds are also critical to this invention. These waxes are composed of aliphatic alcohols and fatty acid chains of 24 to 48 carbons in length. Jojoba is the primary source of these liquid wax esters. These wax esters tend to bond to metal, coating the wear surfaces and reducing wear. Sulfonated jojoba is utilized (wherein a normal $RCH_2(CH_2)COOH$ is altered to form a long chain sulfate such as $RCH(SO_3H)COOH$ with the application of sulfuric acid, sulfur trioxide or sulfuric acid) as a viscosity enhancer and additional lubrication source for the oil. Currently, oils from transgenic *Brassic napus* (rapeseed and canola) have shown efficacy equal to the of jojoba as a liquid wax ester.

The three components (base oil, hydroxy oil and liquid wax) and the antioxidant (when needed) are simply blended by mechanical or manual means. Any existing free fatty acids or diglycerols may form new triglycerides, combine with alcohols to form new waxes or remain in their native state. Any additives are also blended into the oil. No additional processing of the mixture is needed before use.

The completed blended oil has been noted to have unusual fatty acid compositions atypical of vegetable oils. Methyl esters of free fatty acids from vegetable oils typically occur in even numbered carbon chains. Although it is not completely understood, it is believed that reactions between the different components of the blended oil work to enhance the ability of the sum of the vegetable based composition to act as an effective lubricant. The engine requires that the oil provide hydrodynamic stability. That is it must provide a film between two metal surfaces. The second property is oxidative stability. Vegetable oils, particularly triglycerides, are highly reactive and can undergo cross-linking at unsaturated sites of the fatty acids. The result would be the formation of highly polymerized molecules and eventually the formation of a "plastic" molecule. The presence of the natural and/or synthesized antioxidant inhibits polymerization, extending the life of the oil. The lectins (i.e. lethicin) are also reactive and are believed to bond to any free metal ions as well as water contaminants of the oil, allowing these contaminants to "salt out".

Ongoing tests of the vegetable based oil composition in small four-cycle engines (3.5 to 5 hp) indicate the oil allows the engine to run up to 30% cooler than engines run on conventional petroleum based oils. Moreover, tests indicate that the vegetable based lubricant reduces engine wear by an estimated 10% to 20% over conventionally lubricated engines. This appears to be due to a reduction in friction within the engine. The oil composition, measured by gas chromatographic analysis, without added antioxidants remains relatively constant for up to 25 hours. Beyond 25 hours, a reduction in polyunsaturated 16 and 18 carbon fatty acids (i.e. linoleiate and linolinate) is noted. Twenty (20) carbon chains of free fatty acids are unaffected. Monounsaturated 18 carbon chains are unaffected. The proportion of saturated 16 and 18 carbon (i.e. palmitate and stearate) chains increases dramatically within the 16 to 20 carbon fraction. At 40 hours, the oils show a dramatic increase in saturated 16:0, 18:0 and 20:0 methylated free fatty acids.

The percentage of long chain fatty acids also responds to the function of time. After 25 hours, the percentage of long chain fatty acids changes from an estimated 95 percent of the oil composition to 90 percent. At 40 hours, the long chain component measures 80 to 85 percent of the oil composition. What is suspected to be occurring is a mechanical fracturing or dimerization of the polyunsaturated fatty acid components of the invention. This fracturing may be due to a loss of antioxidants or a loss of antioxidant function at the unsaturated sites.

This description is given for the purposes of illustration and explanation. It will be apparent to those skilled in the art that modifications can be made to the invention as described above without departing from its scope or its spirit.

We claim:

1. A biodegradable liquid lubricant composition consisting essentially of vegetable based products, wherein the composition is made by combining at least:

a hydroxy fatty acid free, vegetable fatty acid triglyceride base oil making up 68 to 90 percent of the composition by volume, wherein at least 65 percent of the fatty acid has a chain length of 16 to 24 carbon atoms;

a vegetable oil additive having hydroxy fatty acids and comprising 5 to 30 percent of the composition by volume; and a liquid vegetable wax comprising 3 to 8 percent of the composition by volume.

2. The lubricant composition of claim 1, wherein the base oil is derived from a vegetable in the Cruciferae family.

3. The lubricant composition of claim 1, wherein the base oil is canola oil.

4. The lubricant composition of claim 1, wherein the base oil is rapeseed oil.

5. The lubricant composition of claim 1, wherein the vegetable oil additive is castor oil.

6. The lubricant composition of claim 1, wherein the vegetable oil additive is lesquerella oil.

7. The lubricant composition of claim 1, wherein the vegetable oil additive is cosmos oil.

8. The lubricant composition of claim 1, wherein the liquid vegetable wax is jojoba wax.

9. The lubricant composition of claim 8, wherein the jojoba wax is sulfonated.

10. The lubricant composition of claim 1, wherein the liquid vegetable wax is meadowfoam wax.

11. A method of using the lubricant composition of claim 1, wherein the composition is used to lubricate an internal combustion engine.

12. The method of claim 11, wherein the internal combustion engine is a two-cycle engine.

13. The method of claim 11, wherein the internal combustion engine is a four-cycle engine.

14. The lubricant composition of claim 1, wherein the base oil is soybean oil.

15. The lubricant composition of claim 1, wherein the base oil is cotton seed oil.

16. The lubricant composition of claim 1, wherein the base oil is sunflower oil.

17. The lubricant composition of claim 1, wherein the base oil is corn oil.

18. A method of using the lubricant composition of claim 1, wherein the composition is used to lubricate an internal combustion diesel engine.

19. A method of using the lubricant composition of claim 1, wherein the composition is used to lubricate rail road rails.

20. A method of using the lubricant composition of claim 1, wherein the composition is used to lubricate a cutting chain for a chain saw.

21. A method of using the lubricant composition of claim 1, wherein the composition is used to lubricate a gear chain.

22. The lubricant composition of claim 1, wherein the base oil is crambe oil.

23. The lubricant composition of claim 1, wherein the base oil is a high oleic soybean oil.

24. The lubricant composition of claim 1, wherein the base oil is a high oleic canola oil.

25. The lubricant composition of claim 1, wherein the base oil is a high oleic rapeseed oil.

26. The lubricant composition of claim 1, wherein the base oil is safflower oil.

27. The lubricant composition of claim 1, wherein the base oil is a high oleic safflower oil.

28. The lubricant composition of claim 1, wherein the base oil is a high oleic sunflower oil.

29. The lubricant composition of claim 1, wherein the base oil is olive oil.

30. The lubricant composition of claim 1, wherein the base oil is peanut oil.

31. The lubricant composition of claim 1, wherein the base oil is flax oil.

32. The lubricant composition of claim 1, wherein the base oil is a blend of at least two vegetable fatty acid triglyceride base oils.

33. The lubricant composition of claim 1, wherein the base oil is a blend of rapeseed oil and canola oil.

34. The lubricant composition of claim 33, wherein the blend is about 80% canola oil and 20% rapeseed oil.

35. The lubricant composition of claim 1, wherein the base oil is a blend of crabe oil and canola oil.

36. The lubricant composition of claim 1, wherein the base oil is a blend of sunflower oil and canola oil.

37. The lubricant composition of claim 1, wherein the base oil is a blend of safflower oil and canola oil.

38. The lubricant composition of claim 1, wherein the base oil is a blend of soybean oil and canola oil.

39. The lubricant composition of claim 38, wherein the blend is about 20% soybean oil and 80% canola oil.

40. The lubricant composition of claim 38, wherein the blend is about 17% soybean oil and 83% canola oil.

41. The lubricant composition of claim 1, wherein the base oil has been subjected to the process of interesterification.

42. The lubricant composition of claim 1, wherein the base oil has been subjected to the process of transesterification.

43. The lubricant composition of claim 1, wherein the base oil has been subjected to the process of alkali isomerization.

44. The lubricant composition of claim 1, wherein the base oil has been subjected to the process of clay catalyzation.

45. The lubricant composition of claim 2, wherein the base oil has been subjected to the process of a Simmons-Smith reaction forming cyclopropanes.

46. The lubricant composition of claim 1, wherein a vegetable fatty acid triglyceride has been subjected to ozygenase enzymes to produce soy hydroxy fatty acids.

47. The lubricant composition of claim 1, wherein said base oil is subjected to two or more of the processes selected from the group consisting of interesterification, transesterification, alkali isomerization, clay catalyzation, and a Simmons-Smith reaction forming cyclopropanes.

48. The lubricant composition of claim 1, wherein the vegetable oil having hydroxy fatty acids is dimerized and esterified.

49. The lubricant composition of claim 1 further comprising an antioxidant up to 5 percent of the composition by volume.

50. The lubricant composition of claim 49, wherein the antioxidant is pyrazine.

51. The lubricant composition of claim 49, wherein the antioxidant is pyridine.

52. The lubricant composition of claim 49, wherein the antioxidant comprises at least one lectin.

53. The lubricant composition of claim 49, wherein the antioxidant comprises at least one alkylated phenol.

54. The lubricant composition of claim 49, wherein the antioxidant comprises at least one polyethers.

55. The lubricant composition of claim 49, wherein the antioxidant comprises at least one substituted triazoles.

56. The lubricant composition of claim 49, wherein the antioxidant comprises at least one diphenolamine.

57. A biodegradable liquid lubricant composition consisting essentially of vegetable based products, wherein the composition is made by combining at least:

a hydroxy fatty acid free, vegetable fatty acid triglyceride base oil making up a majority of the composition wherein at least 65 percent of the fatty acid has a chain length of 16 to 24 carbon atoms, wherein the base oil is derived from a vegetable in the Cruciferae family;

a vegetable oil additive serving as a source of hydroxy fatty acids; and a liquid vegetable wax.

58. The lubricant composition of claim 57, wherein the base oil is canola oil.

59. The lubricant composition of claim 57, wherein the base oil is rapeseed.

60. A method of using the lubricant composition of 57, wherein the composition is used to lubricate an internal combustion engine.

61. The lubricant composition of claim 57, wherein the vegetable oil additive is castor oil.

62. The lubricant composition of claim 57, wherein the liquid vegetable wax is jojoba.

63. The lubricant composition of claim 62, wherein the jojoba is sulfonated.

64. The lubricant composition of claim 57, wherein the liquid vegetable wax is meadowfoam wax.

65. The lubricant composition of claim 57, wherein the base oil is crambe oil.

66. The lubricant composition of claim 57, wherein the base oil is lesquerella oil.

67. The lubricant composition of claim 57, wherein the base oil is a blend of canola oil and rapeseed oil.

68. The lubricant composition of claim 57, wherein the base oil is a blend of about 80% canola oil and 20% rapeseed oil.

69. The lubricant composition of claim 57, wherein the base oil is a blend of crambe oil and canola oil.

70. The lubricant composition of claim 57, wherein the base oil has been subjected to the process of interesterification.

71. The lubricant composition of claim 57, wherein the base oil has been subjected to the process of transesterification.

72. The lubricant composition of claim 57, wherein the base oil has been subjected to the process of alkali isomerization.

73. The lubricant composition of claim 57, wherein the base oil has been subjected to the process of clay catalyzation.

74. The lubricant composition of claim 57, wherein the base oil has been subjected to the process of a Simmons-Smith reaction forming cyclopropanes.

75. The lubricant composition of claim 57, wherein a vegetable fatty acid triglyceride has been subjected to ozygenase enzymes to produce soy hydroxy fatty acids.

76. The lubricant composition of claim 57, wherein said base oil is subjected to two or more of the processes selected from the group consisting of interesterification, transesterification, alkali isomerization, clay catalyzation, and a Simmons-Smith reaction forming cyclopropanes.

77. The lubricant composition of claim 57, wherein the vegetable oil having hydroxy fatty acids is dimerized and esterified.

78. The lubricant composition of claim 57 further comprising an antioxidant.

79. The lubricant composition of claim 78, wherein the antioxidant is pyrazine.

80. The lubricant composition of claim 78, wherein the antioxidant is pyridine.

81. The lubricant composition of claim 78, wherein the antioxidant comprises at least one lectin.

82. The lubricant composition of claim 78 wherein the antioxidant comprises at least one alkylated phenol.

83. The lubricant composition of claim 78, wherein the antioxidant comprises at least one polyether.

84. The lubricant composition of claim 78, wherein the antioxidant comprises at least one substituted triazole.

85. The lubricant composition of claim 78, wherein the antioxidant comprises at least one diphenolamine.

86. A process of making a biodegradable liquid lubricant composition consisting essentially of vegetable based products, wherein:

a hydroxy fatty acid free, vegetable fatty acid triglyceride base oil making up 65 to 90 percent of the composition by volume, wherein at least 65 percent of the fatty acid has a chain length of 16 to 24 carbon atoms, is combined with;

a vegetable oil additive having hydroxy fatty acids and comprising 5 to 20 percent of the composition by volume; and liquid vegetable wax comprising 3 to 8 percent of the composition by volume.

87. The process of claim 86, wherein the base oil is derived from a vegetable in the Cruciferae family.

88. The process of claim 86, wherein the base oil is canola oil.

89. The process of claim 86, wherein the base oil is rapeseed oil.

90. The process of claim 86, wherein the base oil is crambe oil.

91. The process of claim 86, wherein the liquid vegetable wax is jojoba wax.

92. The process of claim 91, wherein the jojoba wax is sulfonated.

93. The process of claim 86, wherein the liquid vegetable wax is meadowfoam wax.

94. The process of claim 86, wherein the base oil has been subjected to the process of interesterification.

95. The process of claim 86, wherein the base oil has been subjected to the process of transesterification.

96. The process of claim 86, wherein the base oil has been subjected to the process of alkali isomerization.

97. The process of claim 86, wherein the base oil has been subjected to the process of clay catalyzation.

98. The process of claim 86, wherein the base oil has been subjected to the process of a Simmons-Smith reaction forming cyclopropanes.

99. The process of claim 86, wherein a vegetable fatty acid triglyceride has been subjected to ozygenase enzymes to produce soy hydroxy fatty acids.

100. The process of claim 86, wherein said base oil is subjected to two or more of the processes selected from the group consisting of interesterification, transesterification, alkali isomerization, clay catalyzation, and a Simmons-Smith reaction forming cyclopropanes.

101. The process of claim 86, wherein the vegetable oil having hydroxy fatty acids is dimerized and esterified.

102. The process of claim 86, further comprising adding an antioxidant up to 5 percent of the composition by volume.

103. The process of claim 102, wherein the antioxidant is pyrazine.

104. The process of claim 102, wherein the antioxidant is pyridine.

105. The process of claim 102, wherein the antioxidant comprises at least one lectin.

106. The process of claim 102, wherein the antioxidant comprises at least one alkylated phenol.

107. The process of claim 102, wherein the antioxidant comprises at least one polyether.

108. The process of claim 102, wherein the antioxidant comprises at least one substituted triazole.

109. The process of claim 102, wherein the antioxidant comprises at least one diphenolamine.

110. The process of claim 86, wherein the base oil is crambe oil.

111. The process of claim 86, wherein the base oil is a high oleic soybean oil.

112. The process of claim 86, wherein the base oil is a high oleic canola oil.

113. The process of claim 86, wherein the base oil is a high oleic rapeseed oil.

114. The process of claim 86, wherein the base oil is safflower oil.

115. The process of claim 86, wherein the base oil is a high oleic safflower oil.

116. The process of claim 86, wherein the base oil is sunflower oil.

117. The process of claim 86, wherein the base oil is a high oleic sunflower oil.

118. The process of claim 86, wherein the base oil is cotton seed oil.

119. The process of claim 86, wherein the base oil is corn oil.

120. The process of claim 86, wherein the base oil is olive oil.

121. The process of claim 86, wherein the base oil is peanut oil.

122. The process of claim 86, wherein the base oil is flax oil.

123. The process of claim 86, wherein the base oil is a blend of at least two hydroxy fatty acid free, vegetable fatty acid triglyceride base oils.

124. The process of claim 86, wherein the base oil is a blend of rapeseed oil and canola oil.

125. The process of claim 124, wherein the blend is about 80% canola oil and 20% rapeseed oil.

126. The process of claim 86, wherein the base oil is a blend of crambe oil and canola oil.

127. The process of claim 86, wherein the base oil is a blend of sunflower oil and canola oil.

128. The process of claim 86, wherein the base oil is a blend of safflower oil and canola oil.

129. The process of claim 86, wherein the base oil is a blend of soybean oil and canola oil.

130. The process of claim 129, wherein the blend is about 20% soybean oil and 80% canola oil.

131. The process of claim 129, wherein the blend is about 17% soybean oil and 83% canola oil.

* * * * *